US008740218B2

(12) United States Patent
Just

(10) Patent No.: US 8,740,218 B2
(45) Date of Patent: Jun. 3, 2014

(54) MODULAR SYSTEM FOR HANDING OUT PLAYING CARDS AND A MODULE FOR HANDING OUT CARDS FOR SUCH SYSTEM

(75) Inventor: Peter Just, Copenhagen (DK)

(73) Assignee: Bridge4People A/S, Soborg (DK)

( * ) Notice: Subject to any disclaimer, the term of this patent is extended or adjusted under 35 U.S.C. 154(b) by 0 days.

(21) Appl. No.: 13/397,262

(22) Filed: Feb. 15, 2012

(65) Prior Publication Data

US 2012/0313322 A1 Dec. 13, 2012

Related U.S. Application Data

(63) Continuation of application No. 12/312,545, filed as application No. PCT/DK2007/000504 on Nov. 15, 2007, now abandoned.

(30) Foreign Application Priority Data

Nov. 17, 2006 (DK) ..... 2006 01510

(51) Int. Cl.
*A63F 1/12* (2006.01)

(52) U.S. Cl.
USPC ..... 273/149 R; 273/309

(58) Field of Classification Search
USPC ..... 273/309, 149 R, 149 P
See application file for complete search history.

(56) References Cited

U.S. PATENT DOCUMENTS

| | | | | |
|---|---|---|---|---|
| 6,695,311 | B2 * | 2/2004 | Yu et al. | 273/273 |
| 6,811,483 | B1 * | 11/2004 | Webb et al. | 463/16 |
| 7,364,159 | B2 * | 4/2008 | Berman et al. | 273/138.1 |
| 7,559,836 | B2 * | 7/2009 | Gerson et al. | 463/9 |
| 7,887,412 | B2 * | 2/2011 | Baerlocher | 463/25 |
| 7,942,734 | B2 * | 5/2011 | Alderucci et al. | 463/21 |
| 2008/0146311 | A1 * | 6/2008 | Walker et al. | 463/20 |
| 2010/0203940 | A1 * | 8/2010 | Alderucci et al. | 463/16 |
| 2010/0203953 | A1 * | 8/2010 | Alderucci et al. | 463/25 |

* cited by examiner

*Primary Examiner* — William Pierce
(74) *Attorney, Agent, or Firm* — Oliff PLC

(57) ABSTRACT

A modular system for handing out playing cards, including at least one card-handing module and a frame module. Additionally, the system preferably also includes a power supply module and a score module. The card-handing module is particularly suitable for partaking as a replaceable component in connection with the other modules, and includes an essentially closed housing which substantially encloses a rotating spinner core. The card-handing module is configured for being able to receive a deck of playing cards and ejects the playing cards individually and in a specific direction that is determined by a step motor. The spinner core is suspended in the housing by two opposed bearings, where the motor constitutes the one bearing, while an opposed bearing is provided. Thereby a very compact unit is provided which is so noiseless that it can sit on a bridge game table and function without being a nuisance to the players.

19 Claims, 3 Drawing Sheets

Figure 1:
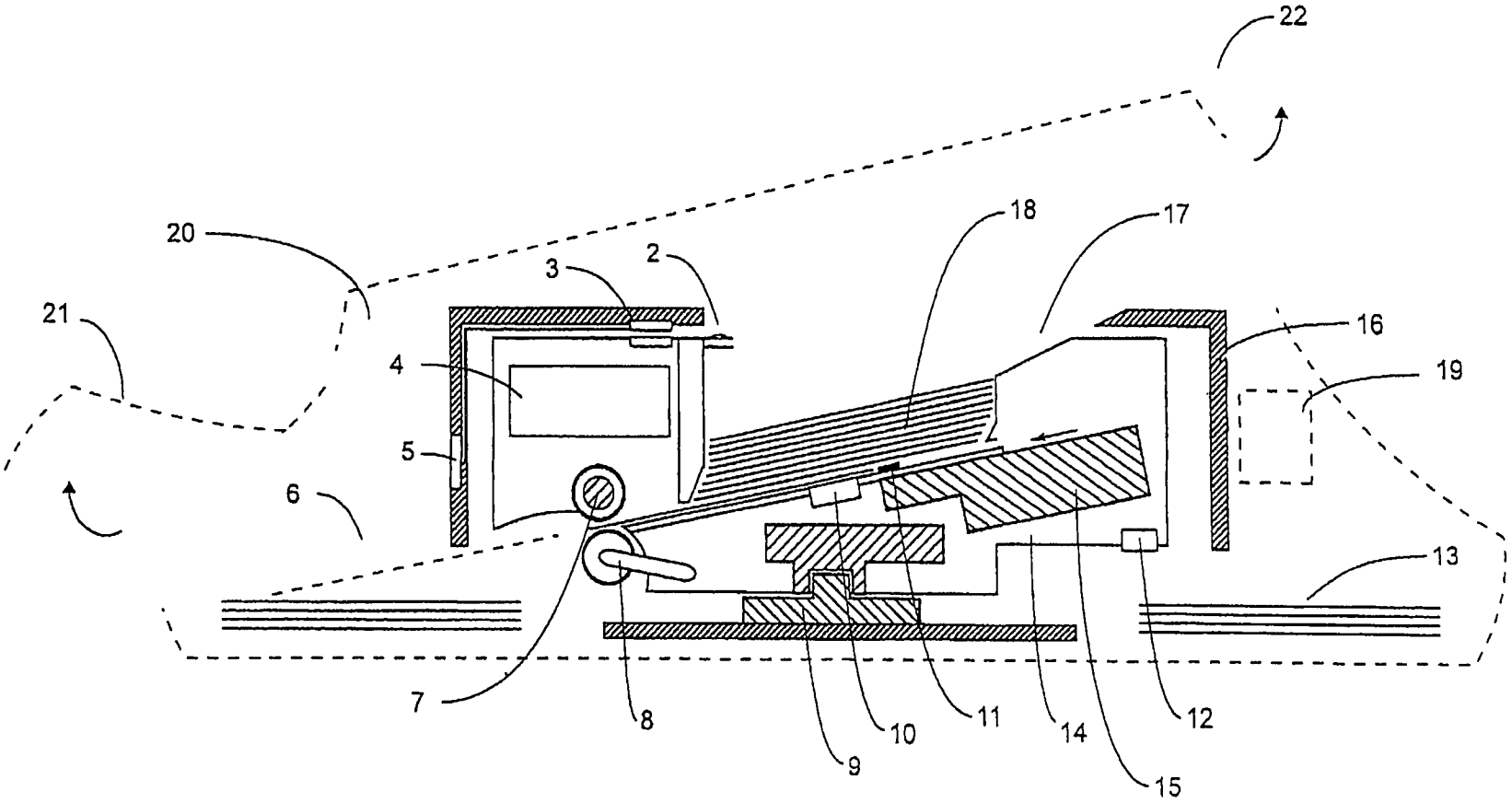

MODULAR SYSTEM FOR HANDING OUT PLAYING CARDS AND A MODULE FOR HANDING OUT CARDS FOR SUCH SYSTEM

This is a Continuation of application Ser. No. 12/312,545 filed Apr. 30, 2010, which is a National Phase of Application No. PCT/DK2007/000504, filed Nov. 15, 2007. The disclosure of the prior applications is hereby incorporated by reference herein in its entirety.

The invention relates to a modular system for handing out playing cards, eg for handing out the playing cards in four piles, one for each player at a bridge table. The invention is not limited to concern the handing out of cards for games of bridge, but, as will become apparent further down, the invention enables a flexible system which is suitable in particular for games of bridge, where, during tournaments, eg duplicate bridge is played or barometer tournaments. For that use in particular it is a problem to pile the cards for the tournament.

FR 2 576 518 discloses an apparatus for handing out playing cards. That apparatus is large and heavy and produces quite some noise, meaning that it is suitable exclusively for being located in a room at the rear where the cards are subsequently transferred manually to a number of card folders and are taken to the game room. In case of large tournaments, much attention is focused on this manual handling—whether "it is done properly", and it is therefore important to apply laborious safety procedures.

It is the object of the invention to provide a modular system which is flexible, ie can be adapted to both large and small tournaments and private environments in such a manner that it is attractive from a price point of view, while simultaneously it solves the above problems.

This object is accomplished in that the system comprises at least:

- A card-handing module including a handing-out station for handing out one card at a time in a predetermined direction; and
- A frame module with a number of drawers and configured for receiving the card-handing module in such a manner that a drawer is disposed in each of said predetermined directions.

Thus, the system according to the invention is composed of at least two modules of which the card-handing module is comparatively complex and expensive, while the frame module is somewhat more bulky and less expensive. In case of large bridge tournaments, it is paramount that the modular system according to the invention may sit on the bridge table during the game; and, imagining a game room with 25 tables, it would be inexpedient to have to lock away 25 large frames or tables to avoid theft. According to the invention, the card-handing module is swiftly and readily taken out and put in a lockable cupboard.

Hereby it is enabled that several frames may be provided. Some frames may be intended for sitting on and preferably be attached to a table, and restaurants or cruisers may have their very own solution to the combination of tables and frames in which card distributor modules are arranged as needed.

If a card-handing module were to be broken while there are many tables playing at a time in a game room, it is considerably easier to merely replace the card-handing module rather than having to replace the entire system, especially if the frame is coherent with or at least attached to the table. As it is, a relatively large and attached frame will have a high sound-silencing effect which is very important to the applicability of the system during the game as such.

The system also comprises a power-supply module configured for being located in the card-handing module or in the frame module. The power-supply module may be a transformer, ordinary batteries or rechargeable batteries, and therefore it will make the system according to the invention extra flexible by enabling that the power-supply module is easily inserted into and removed from one of the other modules.

The system according to the invention further comprises a score-module with an electronic storage configured for containing information on how a deck of cards is to be dealt and for transferring the information to the card-handing module which is configured for such communication. Moreover, the score-module is configured for being able to receive score-information in respect of a finished game and for being able to communicate with other score modules, whereby the tournament and the scores can be processed electronically. By means of a suitable central data processing plant duplicate games of bridge and barometer tournaments can be held.

Preferably, the frame has an opening at the top for insertion and removal of the card-handing module, which is typically in the shape of a cylinder, to the effect that the opening is typically circular. To muffle the sound as much as possible, it is preferred to provide the frame with an openable lid, and the frame may, as mentioned above, by additionally silenced, eg through its weight, attachment to a card table or by means of other sound-silencing measures.

The invention also relates to a card-handing module comprising a rotatable card cartridge for accommodating a deck of playing cards, each of which is provided with a readable code, and including means for reading said code and for ejecting one single card in response to an item of information which is stored in a control unit that comprises a motor for turning and positioning the cartridge in a number of angular positions in response to the information contained in the control unit.

The card-handing module is characterised in that it comprises an outer housing which is stationary and essentially closed for enclosing a spinner which is which is rotatably journalled within the housing, said spinner accommodating the cartridge and means for reading and ejecting playing cards and containing the control unit and the motor, said housing having openings for introducing playing cards and for passage of playing cards that are ejected in said number of angular positions.

The outer housing means that the card-handing module can easily be moved between various frames; and that the spinner can be balanced and rotated while producing very weak vibrations. By making the housing slightly sturdier and heavier it will both stabilise the spinner extraordinarily eg via a bottom bearing and provide an additional sound-silencing effect. The motor may be a step motor or may be configured for continuous rotation of the spinner.

Preferably the housing is configured for being connectable to a battery in the frame module and for being able to transfer power to the spinner via one of said bearings. Thereby it is avoided that the spinner is to include a power supply which would make the spinner heavier and hence require more power and hence produce more heavy vibrations.

The card-handing module may be made compact in other ways to reduce the power consumption and vibrations. For instance it would be obvious that a relatively small reduction in the diameter of the card-handing module would entail a relatively large reduction in its momentum of inertia, and it follows that the card-handing module must be configured such that its diameter is as small as possible. This is accomplished is in that the means for reading the code on the playing cards do not presuppose that the playing card must travel a distance before the code can be read. By the reading means comprising a stationary group of detectors that entirely covers the code on the cards, the code can be read without the cards moving.

Figure 2:
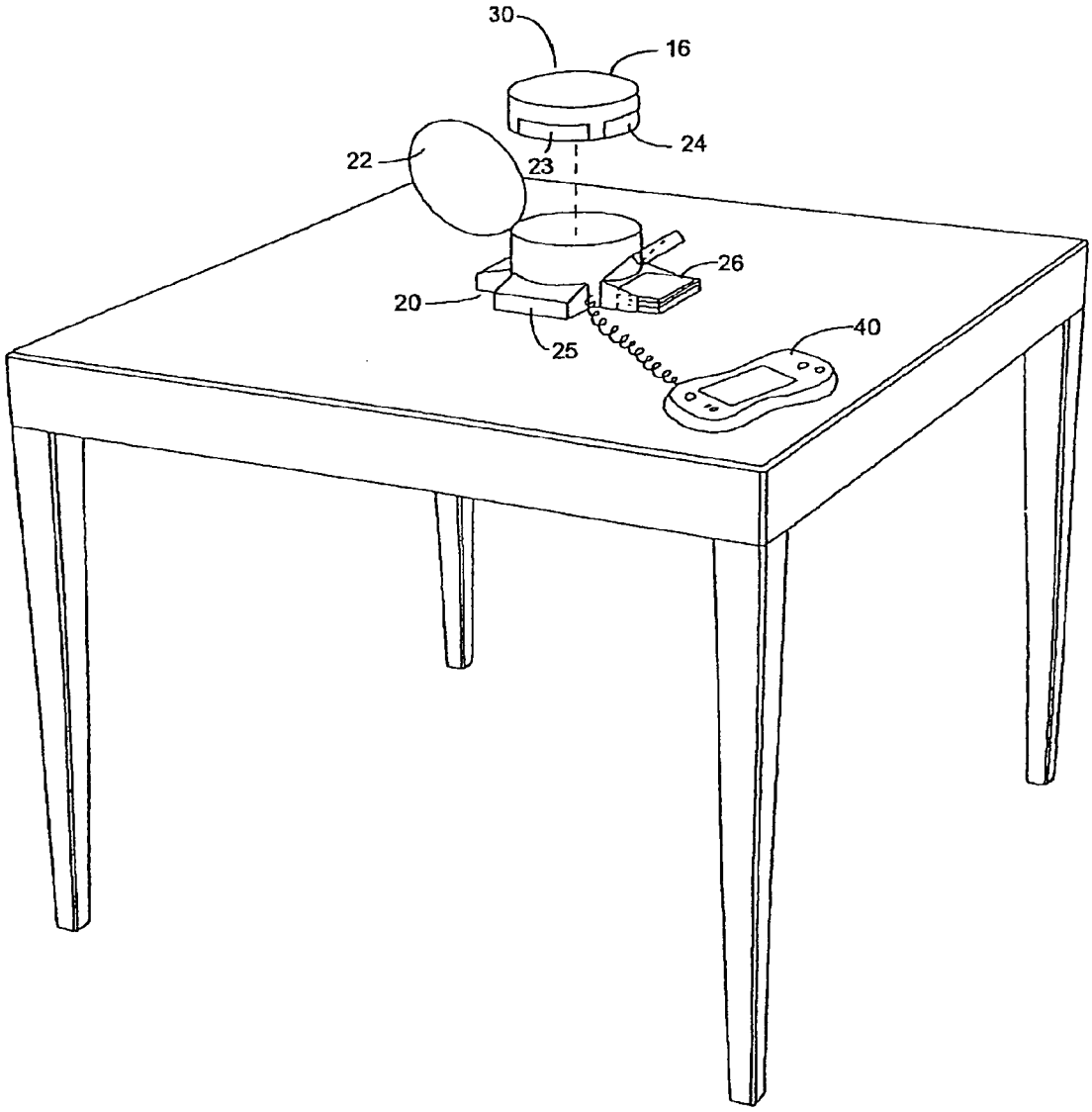
Figure 3:
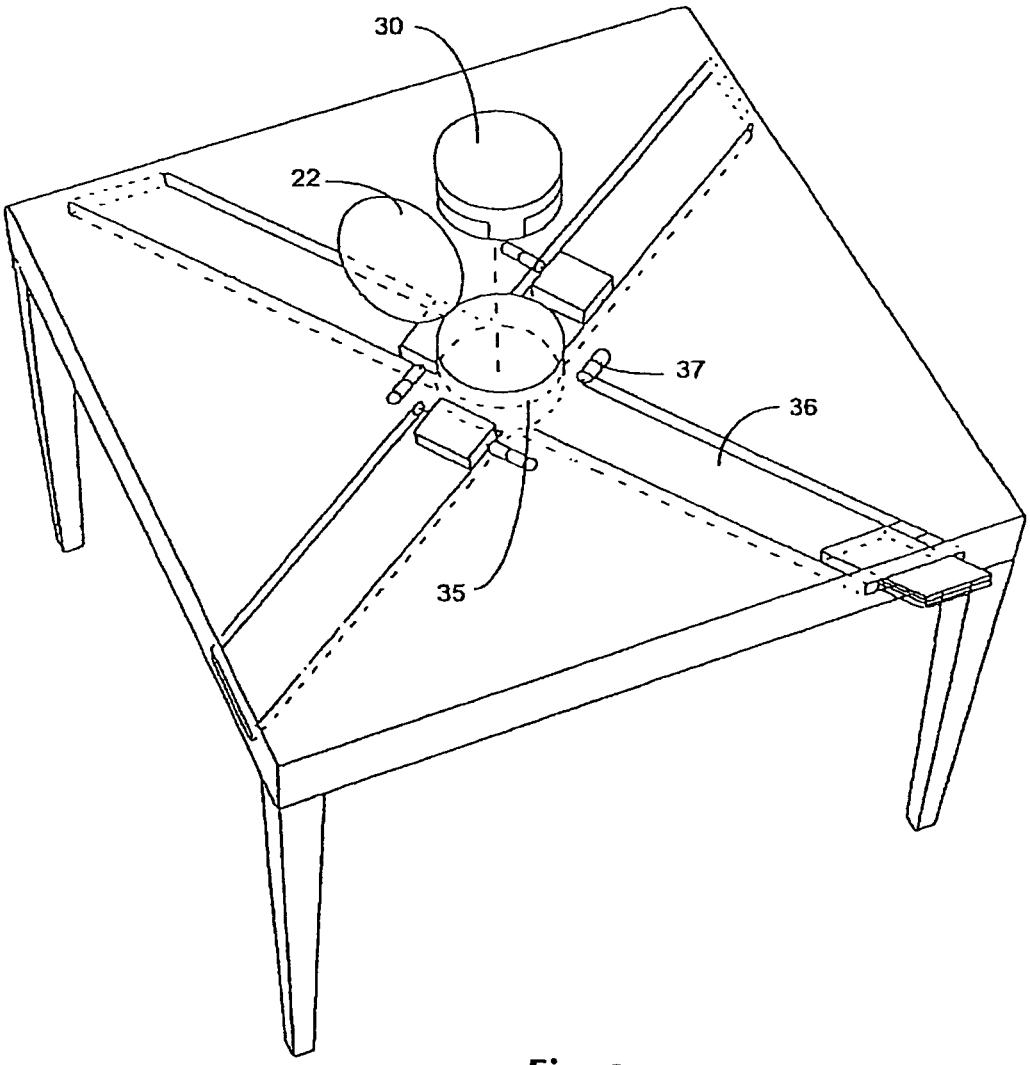

The invention will be explained in further detail with reference to the following description of exemplary embodiments, reference being made to the drawing, wherein:

FIG. 1 schematically shows an embodiment of a card-handing module and an outline of a frame module according to the invention;

FIG. 2 shows an embodiment of a modular system according to the invention, disposed on a table; while FIG. 3 shows a further embodiment of a modular system according to the invention, disposed underneath a table.

Reference being first made to FIG. 1, now follows a preliminary exposition of a card-handing module 30 and a frame module 20. Then, reference being made to FIGS. 2 and 3, various configurations of the module units will be explained. Finally, a more detailed description of the modules 20 and 30 shown in the figures will be given ultimately.

The card-handing module 30 comprises a solid housing 16 that essentially comprises a rotating spinner core 14. The card-handing module 30 is configured for being able to receive a deck of playing cards 18 and comprises means that will be described at a later stage for ejecting the playing cards individually in a specific direction. The direction can be changed by means of a rotating motor 9 which is configured for being able to control the rotating spinner core 14 such that it is possible to hand out a card in four different directions, in case of a game of bridge designated north, south, east and west. By adequate control of the ejection means and the motor, the cards may be handed out in four different directions through four slots in the stationary housing 16 which is furthermore provided with an opening for introducing a pile of cards.

By a dotted line FIG. 1 shows an embodiment of a frame module 20 according to the invention which is capable of completely enclosing the card-handing module 30. However, the frame module 20 has different openable openings, such as a lid 22, which are used if the card-handing module 30 is to be replaced, or when a deck of playing cards is to be arranged in the rotating spinner core 14. Moreover, the frame module 20 has four openings in the north, south, east, west directions, reference numeral 21 being used to designate a lid for a card compartment.

In the frame module 20 a power supply module 19 is further provided, and by means of an I/O port 5 a score module 40 may be connected which is shown in FIG. 2.

FIG. 2 shows an example of use of the above-described modules. The card-handing model 30 comprises the shown housing 16 that has four openings for passage of playing cards, where openings 23 and 24 are shown.

During use of the modular system according to the invention, the card-handing module 30 is arranged in the shown frame module 20, following which the lid is closed. As will be described in further detail below, the card-handing module 30 delivers the cards individually to four different card compartments, where the card compartment 25 is shown in closed position, whereas the card compartment 26 is shown in open position for discharge of "a hand", ie the 13 cards that eg a bridge player uses.

FIG. 2 also shows a score module 40 which may be any kind of electronic apparatus, such as computer, mobile phone, PDA or the like, that contains information on how the cards are to be handed out. Such information is, as will be described below, transferred to the card-handing module 30. Moreover, it is possible, when the game is over, to code bids and information on the game results, thereby enabling quick calculation of a result, the score module 40 being configured for communicating, preferably wirelessly, with other corresponding modules and/or with a central calculator module in a bridge facility where many players may be gathered. The score module 40 may also communicate with an internet server to the effect that the players are able to play with each other throughout the world without having to be located in the same geographical place.

It is possible to couple ordinary mains voltage to the frame module 20 which may have a transformer for supplying mains power either directly or indirectly via a rechargeable power supply module 19 as shown in FIG. 1. It may also comprise ordinary batteries, but by configuring the power supply module as an exchangeable module, the system according to the invention may be used in different environments without problems.

The latter flexibility is absolutely not limited to the power supply module 19. The major advantage of the system is that the system is divided into the modules already mentioned which may be configured in various ways and which may be mutually interconnected in various ways. FIG. 3 shows an example of how the card-handing module 30 can be arranged underneath a table which has means for transporting a set of card to each individual player. In FIG. 3 the element designated by frame module 30 above is arranged underneath the table, where it is designated by 35. The frame module is interconnected with a number of conveyor channels 36 for receiving a tray that can be moved from the frame 35 to the rim of the table by means of respective motors 37 to the effect that a set of playing cards can be moved from the frame and towards the rim of the table. According to one embodiment the frame module 35 can be in communication with the channels 36 and the motors 37.

The embodiment shown in FIG. 3 is a relatively expensive embodiment, but, in return, it provides ideal exploitation of the individual modules according to the invention. This is due to the fact that it is possible to make the lid 22 particularly sound-silencing; and in that the frame module 35, optionally with the passages 36 coupled thereto, is relatively heavy, the system according to the invention will be able to operate more or less completely silent and hence not be a nuisance to the players. If a card module 30 were to break during the game, it will be possible to quickly exchange it with an operative card-handing module. It is not necessary to replace the entire table. In the event that an error occurs in connection with the means for advancing the playing cards underneath table, it is an option to remove the card-handing module 30 and put a frame module 20 as shown in FIG. 2 on the table, following which the card-handing module is repositioned. One does thus not have to reprogram the card-handing module 30 in connection with such replacement.

The system according to the invention is not limited to the embodiments shown in FIGS. 2 and 3, it being understood that the individual modules can be combined in many different ways and in many different embodiments, depending on how it is to be used. The use may comprise that only the disclosures shown in FIG. 1 are used, and which may be used at home or in bridge clubs. It is conceivable that a bridge club has at its disposal a number of tables of the kind shown in FIG. 3 and a number of card-handing modules 30 where the modules can be used as needed. In bridge clubs it is also conceivable to have a recharger apparatus for charging a number of power supply modules 19 that are arranged in the frame module 20 prior to a game night.

Now follows a detailed explanation of the card-handing module 30 which is shown in FIG. 1.

The motor may be a so-called step motor that comprises a number of coils, each of which is provided separately with power to the effect that a magnetic rotor can be controlled to adjust to predetermined angular positions determined by the location of the coils. For distribution of the playing cards to four players, a motor with four angular positions will be used. The angle is determined by means of the coil current which is controlled by the control unit 4. A suitable motor could be eg series 12 or 2008 from FTB GmbH under Faulhaber-Group.

By 4 is designated a control computer configured for being able to receive information via an infrared coupling 3 that is connected to a plug 5 by which it is possible to transfer information into ad out of the card-handing module 30. By a preferred embodiment, the information is transferred by means of the score-module designated by 40 in FIG. 2. It will thus be understood that the power supply module 19 can also be connected to the plug connection 5 in case power is received from the outside. Otherwise the power supply module 19 will be connected to all other power-consuming parts of the card-handing module.

The individual playing cards are pushed out of the card-handing module 30 by means of a linear motor 15 that operates a plate that includes an impact face 11 abutting on an edge of a playing card. When the linear engine 15 has moved the card a predetermined distance the card will be caught between a motor-driven pressure wheel 7 and a pressure wheel 8 with a sensor. The latter parts 7 and 8 will convey the card out through the slot, eg 23 in the card-handing module, to the drawer 25.

Thus, the dealing of cards takes place in that each playing card comprises a bar code which is read by a bar-code reader 10. If eg a king of hearts is detected, that information will proceed to the computer 4 on which information is encoded that the king of hearts is to be delivered to eg the player who is in the east position. By means of the linear motor 9, the card-handing module 30 is turned such that the delivery opening of the spinner core 14 is facing the drawer, eg 25 or 26, that faces eastwards. Then the card is pushed out by means of the linear motor 15 and rollers 7, 8. Then the next card is read, and so on.

The rotating spinner core 14 may be provided with a number of other detectors to enable quicker, more reliable operation or in other ways to increase the user-friendliness of the apparatus. Reference numeral 2 is used to show a sensor that can be used to inform the users that the cards have been handed out correctly, and by 12 another sensor is shown which is configured to read the status of the card drawers.

To reduce the noise to practically inaudible level, it is also attempted to make the weight and radius of the rotating spinner core as small as possible. This can be accomplished eg by the bar code reader 10 comprising an array of individual bar code readers that are able to read the entire bar code without the playing card having to be moved relative to the bar code reader. Thereby the radial movement of the playing card within the spinner core 14 can be shortened, whereby the diameter of the spinner core can be reduced.

The card-handing module is, as already explained, essentially enclosed by the housing 16 which contributes to reducing the noise level during operation. Both the housing 16 and eg the frame module 20 may be provided with extra noise-silencing measures to the effect that the system according to the invention is not a nuisance/distraction to the players. Thereby it is possible to use the system according to the invention on the card table as such, which enables entirely new options for flexible utilisation of state-of-the art technique.

As already mentioned, the score module 40 may be in communication with all other score modules, preferably via wireless connection, and all of the modules may be in communication with a central computer that emits information as to how the cards are to be dealt at the individual tables and which is able to receive information about the game results and calculate a list of results.

All of these advantages depend on the possibility of the cards being handed out at the game table as such, and that requirement is solved precisely by the modular system according to the invention and in such a manner that the system is flexible, both with regard to use and with regard to price.

The invention claimed is:

1. A modular system for handing out playing cards in a deck, comprising:

a card-handing module comprising:

a control unit that includes a motor;

a rotatable spinner core for accommodating a stacked deck of playing cards, each of which cards is provided with a readable code, the spinner core including means for reading said code and for ejecting one single card in response to an item of information which is stored in the control unit that includes the motor for turning and positioning a cartridge in response to the information contained in the control unit;

an outer housing which is stationary and essentially closed for enclosing the spinner core which is rotatably journalled within the housing by means of the motor having four angular positions, wherein:

said spinner core accommodating the means for reading and ejecting playing cards and containing the control unit and the motor, said housing having openings for introducing playing cards and for passage of playing cards accomplished in said number of angular positions, the means for reading said code rotates together with the spinner core, and the card-handing module including a handing-out station for ejecting one card at a time in a predetermined direction, and the motor having four angular positions, the card-handing module including only a single compartment configured to receive the deck; and a frame module with a number of card compartments and configured for receiving the card-handing module in such a manner that a card compartment is disposed in each of said predetermined directions and that the card-handing module can be taken readily out from the frame module;

wherein the frame module has an opening at the top for insertion and removal of the card-handing module.

2. A system according to claim 1, further comprising a power supply module that is configured for being arranged in the card-handing module or in the frame module.

3. A system according to claim 1, wherein the card-handing module has means for wireless transfer of information, and that a programmable score module with an electronic storage is provided which is configured for containing information on how a set of cards is to be handed out; and is configured for transferring information to the card-handing module.

4. A system according to claim 3, wherein the score module is configured for receiving score information and for being able to communicate with other score modules.

5. A system according to claim 1, wherein the frame module is configured for sitting on a table.

6. A system according to claim 1, wherein the frame module is configured for being arranged completely or partially underneath a table.

7. A system according to claim 1, wherein the frame module is an integral part of a table.

8. A system according to claim 5, wherein the frame module comprises four openable spaces for receiving the playing cards that are distributed by means of the card-handing module.

9. A system according to claim 1, wherein the opening has an openable lid.

10. A system according to claim 5, wherein the frame module is silenced.

11. A card-handing module comprising:

a control unit that includes a motor;

a rotatable spinner core for accommodating a stacked deck of playing cards, each of which cards is provided with a readable code, the spinner core including means for reading said code and for ejecting one single card in response to an item of information which is stored in the control unit that includes the motor for turning and positioning a cartridge in response to the information contained in the control unit;

an outer housing which is stationary and essentially closed for enclosing the spinner core which is rotatably journalled within the housing by means of the motor having four angular positions, wherein:

said spinner core accommodating the means for reading and ejecting playing cards and containing the control unit and the motor, said housing having openings for introducing playing cards and for passage of playing cards accomplished in said number of angular positions, and the means for reading said code rotates together with the spinner core.

12. A module according to claim 11, wherein the motor is a step motor.

13. A module according to claim 11, wherein the housing is configured for being connected to a battery arranged in the housing module; and for transferring power to the spinner core via one of said bearings.

14. A module according to claim 11, wherein the means for reading the code on the cards are configured for reading a card without the reading means and the cards being moved relative to each other.

15. A module according to claim 14, wherein the means for reading the code on the cards comprise a stationary group of the detectors that completely covers the code on the cards.

16. A module according to claim 11, wherein the housing is silenced.

17. A system according to claim 1, wherein the motor has only four angular positions.

18. A module according to claim 11, wherein the motor has only four angular positions.

19. A module according to claim 14, wherein the means for reading the code on the cards is arranged as a bar code reader comprising an array of individual bar code readers that are able to read the entire bar code without the playing card having to be moved relative to the bar code reader.

* * * * *